US009642439B2

(12) United States Patent
Holloway

(10) Patent No.: US 9,642,439 B2
(45) **Date of Patent: *May 9, 2017**

(54) COSMETIC DISPENSER WITH CRENELATED WALL FOR FRICTIONAL RESISTANCE

(71) Applicant: HCP Packaging USA, Inc., Shelton, CT (US)

(72) Inventor: Thomas F. Holloway, Essex, MD (US)

(73) Assignee: HCP Packaging USA, Inc., Shelton, CT (US)

( * ) Notice: Subject to any disclaimer, the term of this patent is extended or adjusted under 35 U.S.C. 154(b) by 54 days.

This patent is subject to a terminal disclaimer.

(21) Appl. No.: 14/622,579

(22) Filed: Feb. 13, 2015

(65) Prior Publication Data

US 2015/0296958 A1 Oct. 22, 2015

Related U.S. Application Data

(60) Provisional application No. 61/940,022, filed on Feb. 14, 2012.

(51) Int. Cl.
*A45D 40/04* (2006.01)
*A45D 40/06* (2006.01)

(52) U.S. Cl.
CPC ..... *A45D 40/04* (2013.01); *A45D 40/06* (2013.01)

(58) Field of Classification Search
CPC ..... A45D 40/04; A45D 40/06; A45D 40/12; A45D 40/16
See application file for complete search history.

(56) References Cited

U.S. PATENT DOCUMENTS

| | | | |
|---|---|---|---|
| 1,999,263 | A | 4/1935 | Thesmar |
| 2,318,152 | A | 8/1941 | Gelardin |
| 2,351,395 | A | 6/1944 | Broder |
| 2,482,368 | A | 9/1949 | Reichenbach |
| 2,704,598 | A | 3/1955 | Casey |
| 2,815,122 | A | 12/1957 | Lerner et al. |
| 3,298,509 | A | 1/1967 | Hultgren |
| 5,172,993 | A | 12/1992 | Ackermann et al. |
| 5,186,560 | A | 2/1993 | Holloway |
| 5,186,561 | A | 2/1993 | Ackermann et al. |
| 5,324,125 | A | 6/1994 | Ackermann |

(Continued)

*Primary Examiner* — Jennifer C Chiang
*Assistant Examiner* — Bradley Oliver
(74) *Attorney, Agent, or Firm* — Thomas P. O'Connell; O'Connell Law Firm

(57) ABSTRACT

A cosmetic dispenser with an inner body, an outer body, and an elevator cup has a rotary extension and retraction mechanism, a first annular bearing surface retained relative to the inner or outer body and an annular wall retained relative to the other of the outer or inner body. The annular wall can be a skirt of the outer body and can be crenelated into arcuate merlons and crenels. The merlons establish an effective circumference that overlaps with the circumference of the first annular bearing surface to provide frictional resistance to a rotation of the inner body relative to the outer body. The merlons can surround the first annular bearing surface and establish a circumference smaller than the circumference of the first annular bearing surface. The annular bearing surface can be a lateral bearing surface, and a second annular bearing surface can form a longitudinal bearing surface.

22 Claims, 10 Drawing Sheets

(56) References Cited

U.S. PATENT DOCUMENTS

| | | | | |
|---|---|---|---|---|
| 5,324,126 | A | 6/1994 | Holloway et al. | |
| 5,348,410 | A | 9/1994 | Shozi et al. | |
| 5,791,799 | A | 8/1998 | Oehlhorn | |
| 5,851,078 | A | 12/1998 | Bow et al. | |
| 5,979,468 | A | 11/1999 | Blake, III | |
| 6,036,387 | A * | 3/2000 | Gueret | A45D 40/06 401/78 |
| 6,126,351 | A | 10/2000 | Gueret | |
| 6,200,047 | B1 | 3/2001 | Holloway | |
| 6,200,049 | B1 | 3/2001 | Pinhel et al. | |
| 6,231,254 | B1 | 5/2001 | Holloway | |
| 6,293,721 | B1 | 9/2001 | Bow et al. | |
| 6,412,999 | B1 | 7/2002 | Pierpont | |
| 6,543,953 | B1 | 4/2003 | Kim | |
| 6,843,611 | B2 | 1/2005 | Blondeel et al. | |
| 7,325,991 | B2 | 2/2008 | Holloway | |
| 7,500,799 | B2 | 3/2009 | Holloway | |

* cited by examiner

COSMETIC DISPENSER WITH CRENELATED WALL FOR FRICTIONAL RESISTANCE

FIELD OF THE INVENTION

The present invention relates generally to cosmetic containers and dispensers. Stated more particularly, disclosed herein is a device for containing and dispensing cosmetics with a crenelated wall, such as of a spiral member of an extension and retraction mechanism, for creating controlled, consistent frictional resistance between relatively rotatable inner body and spiral member components.

BACKGROUND OF THE INVENTION

In a typical prior art lipstick dispenser, an elevator cup retains a body of lipstick for axial extension and retraction by a swiveling of a base portion in relation to a body portion of the dispenser. Dispensers have commonly employed a cam member with helical threads formed therealong that is rotatably associated with a tubular inner body. The inner body is normally formed with opposed longitudinal tracks. The elevator cup typically has opposed lugs that are received through the longitudinal track and associated with the helical threads of the cam member. Under this arrangement, a rotation of the cam member in relation to the tubular inner body induces the desired axial movement of the elevator cup and the retained body of lipstick as the lugs of the elevator cup slide along the helical threads and the longitudinal tracks.

While effective for its essential purpose, this basic lipstick dispensing design has demonstrated plural disadvantages that have been well recognized in the cosmetic industry. For example, there can be axial and radial looseness between the various components of the lipstick dispenser that can lead to a perceived lack of quality of the device and, by inference, the retained product. The lipstick product can also be perceived as being inferior when the swivel torque required to operate the dispenser is excessively light or inconsistent. Still further, a loosely retained elevator cup can wobble thereby resulting in damage to the product and again reducing the perceived quality thereof.

Conversely, it has been found that a lipstick mechanism with a smooth feel and with consistent torque characteristics lends a perception of quality to the device with a resultant increase in the perceived value of the product. A frictional drag of sufficient significance imparts a firm feel to the device that gives an impression of luxury. Preferably, the frictional drag will remain generally constant during extension and retraction of the lipstick and without regard to whether the dispenser is substantially full or substantially exhausted of cosmetic.

Prior art inventors have proposed numerous arrangements for meeting these needs and goals. In one construction, flexible tabs have portions that project radially from the inner body to provide a frictional engagement with the cam or spiral member. That frictional engagement is intended to provide the dispenser with the desired braking effect and constant swivel torque. Other arrangements have produced a similar frictional engagement by the introduction of fins or ribs on the inner body. It has been found, however, that the tabs and ribs can plastically deform over time thereby losing effectiveness. Additionally, certain of these arrangements can yield an inconsistent swivel torque during travel of the elevator cup since the effective diameter of the relatively moveable components can vary along their length thereby changing the frictional drag in an undesirable manner.

The present inventor has proposed improvements in relation to cosmetic dispensers, such as with U.S. Pat. No. 7,325,991 for a Cosmetic Dispenser with Frictional Drag and U.S. Pat. No. 7,500,799 for a Cosmetic Dispenser with Frictional Swivel Action. Under the teachings of the '991 patent, a protuberance, which can be inflexible, projects from a shoulder portion of the inner body and is aligned with a flexible wall segment of a spiral member to produce a frictional drag therebetween. In the '799 patent, frictional draft was produced between a cam member and an adapter member by one or more drag protuberances therebetween. Still further, with Application No. 61/931,027 filed Jan. 24, 2014, which is incorporated herein by reference, the present inventor proposed a solution, still believed to be quite advantageous, wherein a plurality of fingers projecting from a spiral member frictionally engage an inner body member.

Nonetheless, it has come to be appreciated that needs remain in the art of extendable and retractable cosmetic dispensers. For example, under many prior art mechanisms, the existence of multiple points or locations for generating frictional torque renders it more difficult to control the torque within desired swivel torque ranges. It has been found that customers typically prefer torque resistance from approximately around 2 in. oz. to 6 in. oz. However, it must also be recognized that there is a torque range required for the filling equipment to function smoothly. If the swivel torque is too high, then the machine may turn the elevator cup out of the track on the spiral cam. If the torque is too low, the cosmetic dispenser will feel cheap, and the elevator cup will have a tendency to move when the dispenser is not in use. Moreover, the swivel toque needs to be high enough to prevent the elevator cup from pushing inadvertently retracting when the consumer applies the pomade.

As suggested above, it is desired that swivel torque be consistent throughout the entire processes of elevating or lowering the elevator cup. Under many prior art constructions, the swivel torque varies during the elevation and retraction of the cup, often because such constructions not only had multiple points of contact but also because some of these contact points were moving. For instance, where bumps on the outside wall of the elevator cup are designed to interfere with inside wall of the inner body, the openness of the top of the inner body would produce less resistance than the closed bottom.

Many manufacturers have resorted to adding lubrication seeking to keep swivel torque within the desired range and to make for a smooth feel during extension and retraction. Even if those benefits are achieved, however, the introduction of lubrication creates other issues. For instance, swivel torque can be rendered undesirably low, and lubricant can sometimes get on to the pomade or on the outside of the case.

With a knowledge of the foregoing, the present inventor has appreciated that there is a need for a cosmetic dispenser capable of exhibiting smooth extension and retraction with substantially consistent swivel torque not only over the course of a given extension and retraction cycle but also over the life of the cosmetic dispenser. It is equally clear that there is a need for such a dispenser that is operative without a need for the introduction of lubricant into the system thereby avoiding the potentially deleterious effects thereof. While the invention of the present applicant and others are believed to represent a notable improvement over the known prior art, there remains a need for cosmetic dispensers exhibiting still further improvements in performance and assembly.

SUMMARY OF THE INVENTION

The present invention has as its most broadly stated object the providing of a dispenser for cosmetics, such as lipsticks, that exhibits smooth extension and retraction with substantially consistent swivel torque not only over the course of a given extension and retraction cycle but also over the life of the cosmetic dispenser.

A further object of the invention is to provide a cosmetic dispenser that is operative without a need for the introduction of lubricant into the system thereby avoiding the potentially deleterious effects thereof.

Another object of embodiments of the invention is to provide a cosmetic dispenser that demonstrates a frictional drag during operation of the dispenser to impart a firm feel to the user and provides an impression of quality and luxury during operation.

Still another object of embodiments of the invention is to provide such a cosmetic dispenser that is relatively efficient in construction, assembly, and operation.

An additional object of embodiments of the invention is to provide a cosmetic dispenser that does not exhibit significant static friction when relative movement of the components of the dispenser is initiated and that emits minimized noise during operation to give a sound and feel of quality.

These and further objects and advantages of embodiments of the invention will become obvious not only to one who reviews the present specification and drawings but also to one who has an opportunity to make use of an embodiment of the cosmetic dispenser with a crenelated wall for establishing frictional resistance as disclosed herein. It will be appreciated, however, that, although the accomplishment of each of the foregoing objects in a single embodiment of the invention may be possible and indeed preferred, not all embodiments will seek or need to accomplish each and every potential object and advantage. Nonetheless, all such embodiments should be considered within the scope of the invention.

In one embodiment of the invention, the cosmetic dispenser has an inner body with a proximal end, a distal end, and a body portion, an elevator cup for retaining a pomade of cosmetic, and an outer body with a proximal end, a distal end, and a body portion. The outer body and the inner body are rotatably engaged with a longitudinal axis of relative rotation with the body portion of the inner body received into the body portion of the outer body. The cosmetic dispenser has a rotary extension and retraction mechanism under which the elevator cup can be manipulated between an extended configuration and a retracted configuration by a selective rotation of the inner body relative to the outer body to yield an axial movement of the elevator cup. A first annular bearing surface is retained relative to the inner body or the outer body, and an annular wall is retained relative to the other of the outer body or the inner body wherein. The annular wall has at least a portion thereof crenelated into a plurality of merlons separated by a plurality of crenels, and the plurality of merlons press against the first annular bearing surface to provide frictional resistance to a rotation of the inner body relative to the outer body.

In certain embodiments, the inner body, the outer body, and the elevator cup in cooperation act as the rotary extension and retraction mechanism. For instance, the inner body can have at least one longitudinal track that communicates along a substantial length of the body portion, the elevator cup can have a peripheral wall and at least one lug that projects outwardly from the peripheral wall, and the outer body can comprise a spiral member with at least one spiral formation along an inner surface of the body portion. With that, the at least one lug of the elevator cup can pass through the at least one longitudinal track of the inner body to engage the spiral formation of the spiral member, and a relative rotation of the inner body and the outer body will slide the elevator cup and a retained pomade longitudinally.

The plurality of merlons can establish an effective circumference that overlaps with the circumference of the first annular bearing surface. As used herein, the concept of overlapping of the circumferences shall mean that, where the merlons surround the first annular bearing surface, the merlons have an effective circumference smaller than the circumference of the first annular bearing surface and, where the merlons are surrounded by the first annular bearing surface, the merlons have an effective circumference greater than the circumference of the first annular bearing surface. For instance, the plurality of merlons could surround the first annular bearing surface, and the effective circumference established by the plurality of merlons can be smaller than the circumference of the first annular bearing surface. The effective circumference established by the plurality of merlons could in certain practices of the invention be established at least in part by inwardly projecting protuberances on the plurality of merlons. Additionally or alternatively, it could be established at least in part by an annular ridge on the annular bearing wall.

While it could be opposite, the plurality of merlons can project from the outer body or spiral member and the first annular bearing surface can be retained relative to the inner body. The first annular bearing surface can be substantially concentric with the inner body and substantially longitudinally aligned with the longitudinal axis of rotation. With that, the first annular bearing surface comprises a lateral bearing surface.

Manifestations of the invention can also have a second annular bearing surface, which could be retained relative to the inner body or, where the first annular bearing surface is so retained, the outer body. The second annular bearing surface can be substantially concentric with the inner body and the spiral member, and the second annular bearing surface can be generally orthogonal to the longitudinal axis of rotation. With that, the second annular bearing surface comprises a longitudinal bearing surface. The merlons can have their tips disposed in immediate juxtaposition to the second annular bearing surface, potentially in direct frictional engagement therewith. The second annular bearing surface could, for example, be formed by a ridge retained by the inner body.

It is further disclosed that the inner body can have a base portion coupled to the body portion thereof. There, the first annular bearing surface can comprise an annular bearing wall disposed adjacent to the base portion. Still further, the spiral member can have a skirt coupled to the body portion thereof, and the skirt can be the annular wall that has at least a portion thereof crenelated into the plurality of merlons separated by the plurality of crenels. To optimize performance, the skirt could be formed from polyoxymethylene (POM).

The plurality or merlons can each be arcuate in lateral cross section, such as by being portions of an arcuate wall. Moreover, it is possible for the crenels to have bases with semicircular end portions thereby providing further structural stability to the merlons. Additionally, embodiments are contemplated wherein each of the plurality of merlons is significantly greater in angular span than each of the plurality of interposed crenels. For instance, each of the plurality of merlons could have an angular span at least approximately twice an angular span of each of the plurality of crenels.

One will appreciate that the foregoing discussion broadly outlines the more important goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

Any notes, dimensions, relative dimensions, and details on the drawings are incorporated herein by reference but should not be interpreted as limiting the invention in any manner.

DETAILED DESCRIPTION OF PREFERRED EMBODIMENTS

The cosmetic dispenser with a crenelated wall for frictional resistance disclosed herein is subject to a wide variety of embodiments. However, to ensure that one skilled in the art will be able to understand and, in appropriate cases, practice the present invention, certain preferred embodiments of the broader invention revealed herein are described below and shown in the accompanying drawing figures. Therefore, before any particular embodiment of the invention is explained in detail, it must be made clear that the following details of construction and illustrations of inventive concepts are mere examples of the many possible manifestations of the invention.

Figure 2:
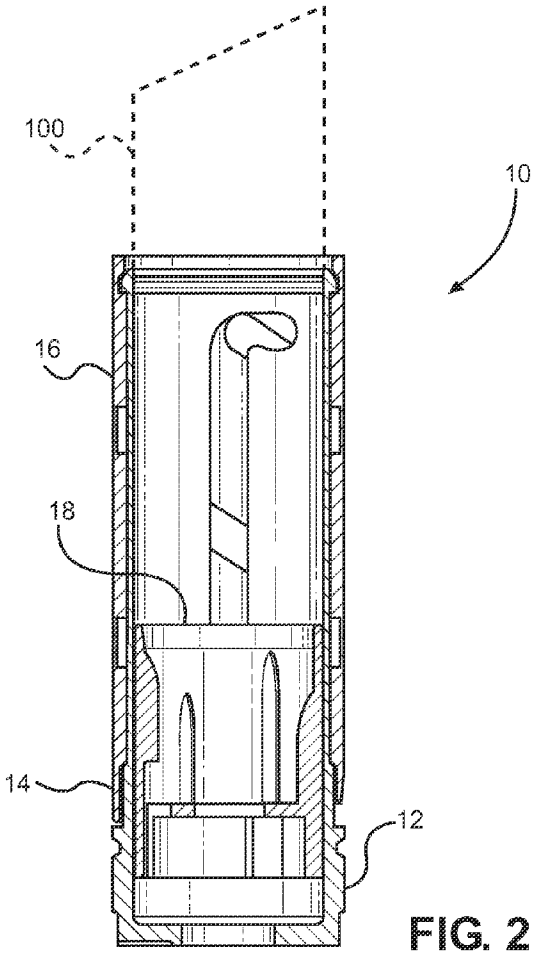
FIG. 2 is a longitudinal cross section of the cosmetic dispenser of FIG. 1 in a retracted disposition.
Figure 1:
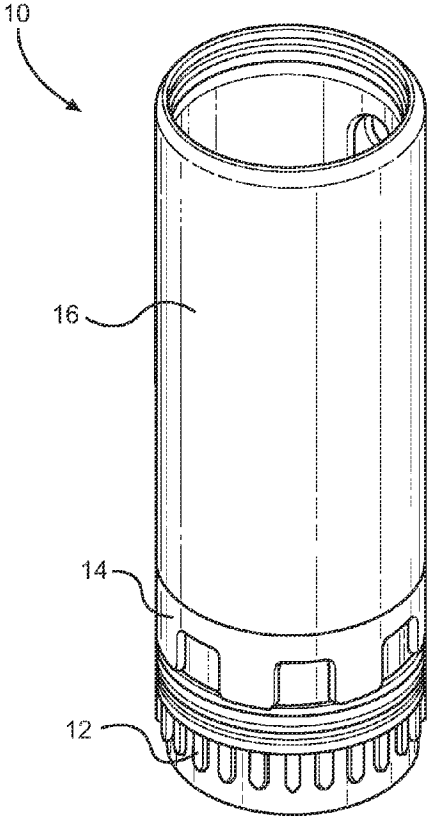
FIG. 1 is a perspective view of a cosmetic dispenser with a crenelated wall for frictional resistance according to the present invention.
Figure 3:
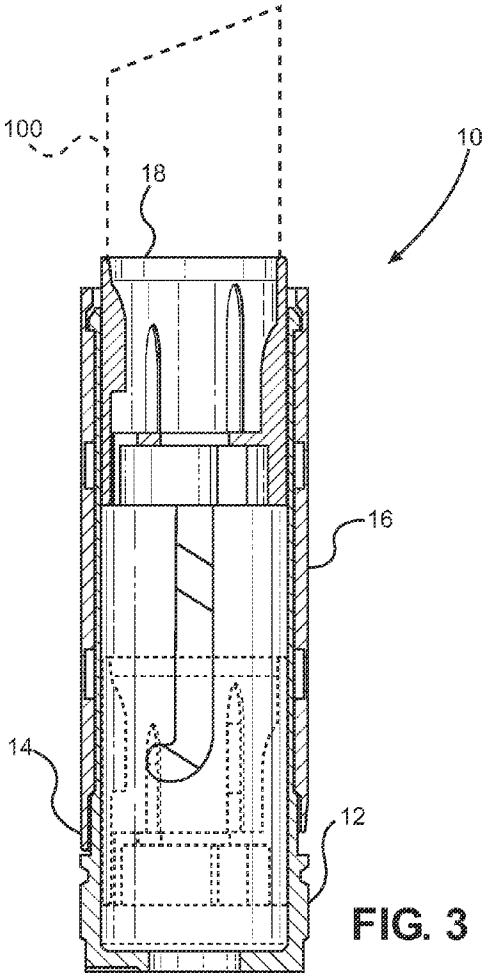
FIG. 3 is a longitudinal cross section of the cosmetic dispenser of FIG. 1 in an extended disposition.

With this in mind and looking more particularly to the accompanying figures, a first exemplary embodiment of a cosmetic dispenser with a crenelated wall for frictional resistance pursuant to the present invention is indicated generally at 10 in FIGS. 1 through 3. The cosmetic dispenser 10 is founded on a tubular inner body 12 that is rotatably engaged with an outer body 14, which may be referred to as a spiral member 14. As will be described more fully hereinbelow, a relative rotation between the inner body 12 and the spiral member 14 yields an axial movement of an elevator cup 18, which is employed to retain a member of lipstick 100, between the extended disposition depicted in FIG. 3 and the retracted disposition depicted in FIG. 2. A tubular shell 16, which can be essentially decorative in nature, can partially or substantially encase the spiral member 14 and, derivatively, the elevator cup 18 disposed therewithin.

For ease of reference, the cosmetic dispenser 10 can be considered to have a proximal end defined as the base of the inner body 12 while the tip of the tubular shell 16 can be considered to define a distal end of the cosmetic dispenser 10. Each component of the cosmetic dispenser 10 can be described under that convention. It should be noted that, while the term member is employed in relation to the spiral member 14 and possibly other components of the cosmetic dispenser 10, each could be formed unitarily as a single piece of material or from multiple subcomponents joined by any effective method to form the respective structure. Just as clearly, except as otherwise described or claimed, the inner body 12, the spiral member 14, the elevator cup 18, and the tubular shell 16 can be formed from any suitable material and by any effective method.

Figure 10:
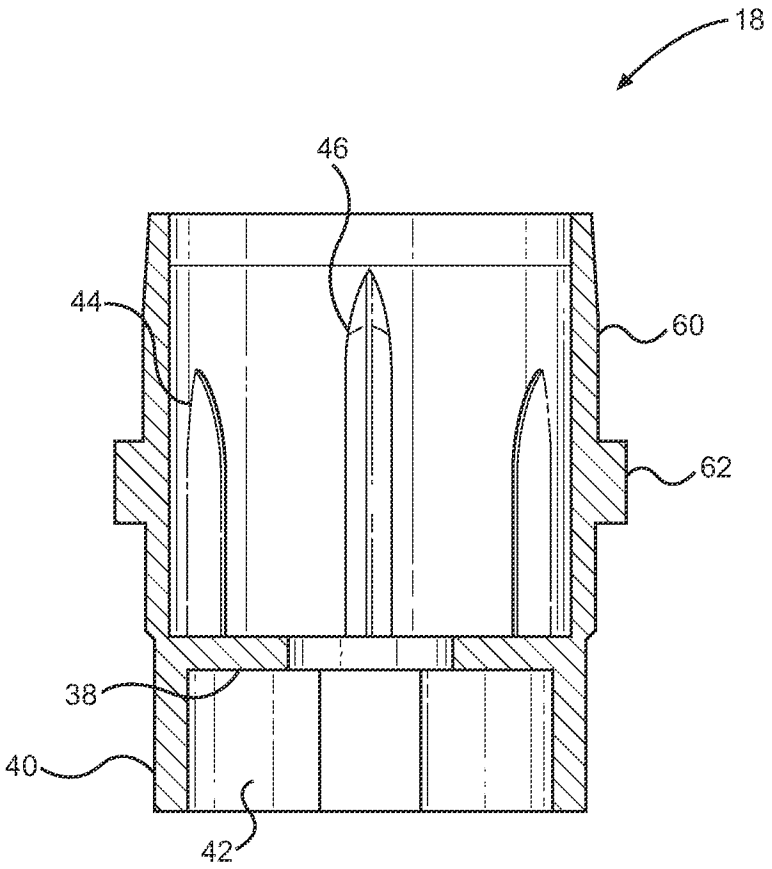
FIG. 10 is a longitudinal cross section of the elevator cup of FIG. 9.
Figure 9:
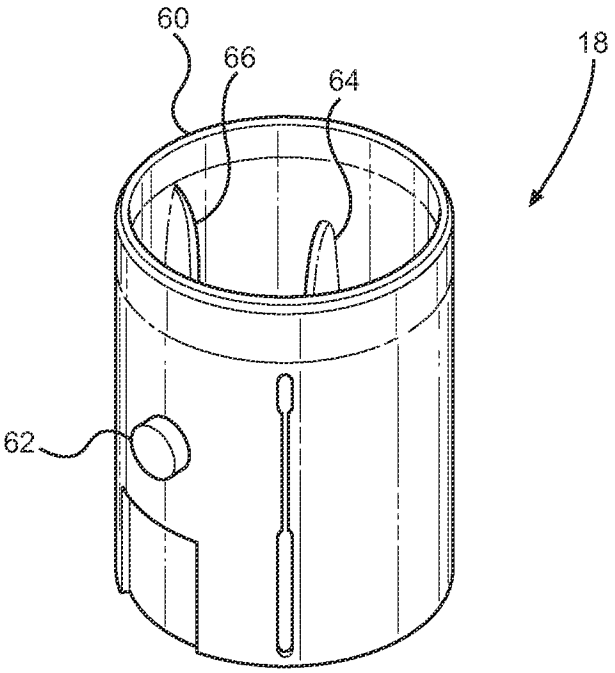
FIG. 9 is a perspective view of an elevator cup for the cosmetic dispenser of FIG. 1.

The elevator cup 18 is shown apart from the remainder of the cosmetic dispenser 10 in FIGS. 9 and 10. There, the elevator cup 18 can be seen to have an open inner volume for receiving a proximal portion of a member of lipstick (not shown). The open inner volume is defined by an annular peripheral wall 60 and a proximal base portion 38. An annular wall extension 40 projects proximally to the base portion 38 to define a cavity 42. A plurality of lower fins 44, each with a proximal end adjacent to the base portion 38 and a distal end terminating at a mid-portion of the peripheral wall 60, project inwardly from the peripheral wall 60. A plurality of upper fins 46, each with a proximal end spaced from the base portion 38 and a distal end terminating at an upper portion of the peripheral wall 60, project inwardly from the peripheral wall 60 spaced along the circumference of the peripheral wall 60 from the lower fins 44.

The fins 44 and 46 can project along radii of the elevator cup 18. Alternatively, the fins 44 and 46 could project in an angled relationship relative to tangents of the annular peripheral wall 60. The fins 44 and 46 can have a distal taper for enabling a most efficient receipt and engagement of the pomade of lipstick. In this example, the fins 44 and 46 are longitudinally aligned with the elevator cup 18 and the cosmetic dispenser 10 in general. One or more elevator lugs 62 projects outwardly from the elevator cup 18, such as from the peripheral wall 60, for engaging the inner body 12 and the spiral member 14 as will be described below. In the depicted example, first and second elevator lugs 62 project from opposed sides of the elevator cup 18 from a mid-portion of the peripheral wall 60.

Figure 4:
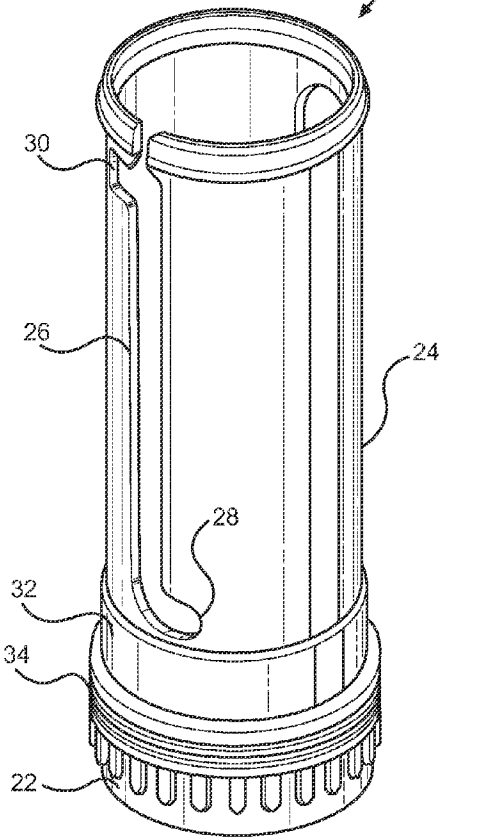
FIG. 4 is a perspective view of an inner body pursuant to the instant invention.
Figure 5:
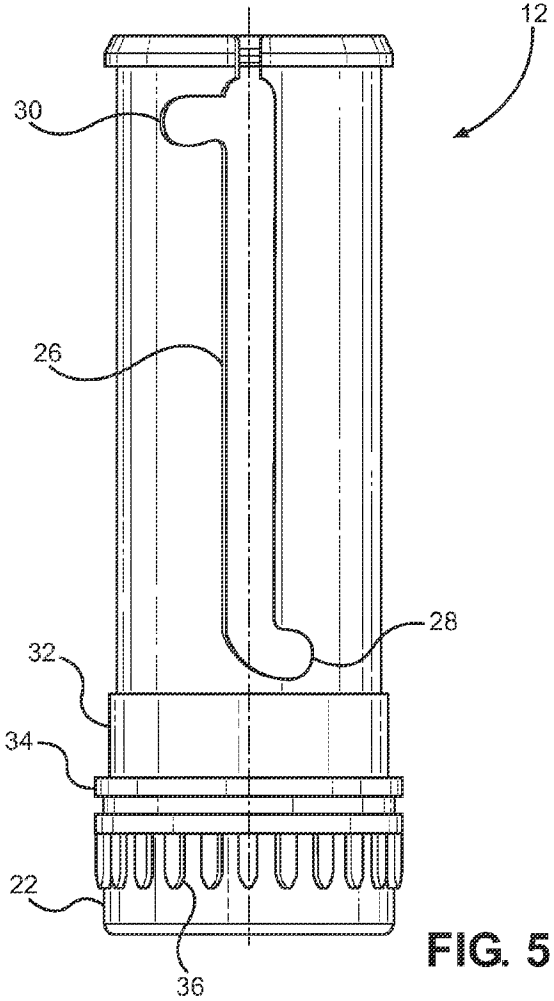
FIG. 5 is a view in front elevation of the inner body of FIG. 4.

The tubular inner body 12 is shown apart from the remainder of the cosmetic dispenser 10 in the views of FIGS. 4 and 5. The inner body 12 has a distally disposed body portion 24 for being received into a body portion 50 of the spiral member 14, which is seen alone in FIGS. 6 through 8. The body portion 24 of the inner body 12 has an outer diameter slightly less than the inner diameter of the body portion 50 of the spiral member 14. A base portion 22 is disposed at a proximal end of the inner body 12, such as by being formed integrally therewith, and a smooth annular bearing wall 32 is interposed between the body portion 24 and the base portion 22. The annular bearing wall 32 is concentric with the inner body 24 and is longitudinally aligned with the body portion 24 and the inner body 12 in general. The annular bearing wall 32 thereby presents what can be referred to as a lateral bearing surface in that lateral force can bear against the annular bearing wall 32.

In the present embodiment, the base portion 22 of the inner body 12 acts as an actuating handle for the inner body 12. As such, gripping ridges 36 are disposed directly on the base portion 22, and a ridge 34 interposed between the gripping ridges 36 and the annular bearing wall 32 presents a smooth annular bearing surface 34 concentric with and orthogonal to the axis of relative rotation of the inner body 12 and the spiral member 14. The smooth bearing surface 34 thereby presents what can be referred to as a longitudinal bearing surface in that longitudinal force can bear against the smooth bearing surface 34.

It will be appreciated, however, that the annular bearing surface 34 could be otherwise created, including, for example, by the affixation of an end cap (not shown) to the proximal end of the inner body 12. Such an end cap could be defined by a peripheral wall and a base with the peripheral wall terminating in a smooth bearing surface that is orthogonal to the axis of rotation of the inner body when the cap is coupled thereto. The end cap could be fixed against longitudinal movement in relation to the inner body by any suitable mechanism, including, for example, by a snap fit engagement between an annular channel in the end cap and an annular ridge disposed adjacent to the proximal end of the inner body 12, and the end cap could fixed to rotate with the inner body 12, such as by mutually engaging facets disposed on the inner body 12 and the end cap.

The inner body 12 has first and second opposed longitudinal tracks 26 that communicate along a substantial length of the body portion 24 of the inner body 12. The longitudinal tracks 26 are disposed in general opposition and pass entirely through the body portion 24. With this, the elevator lugs 62 of the elevator cup 18 pass through the longitudinal tracks 26 to engage the opposed spiral channels 52 of the spiral member 14 of FIGS. 6 through 8. A first longitudinal track 26 can have closed proximal and distal ends while a second longitudinal track 26 can have a closed proximal end and an aperture at the distal end thereof for enabling a receipt of the elevator lugs 62 of the elevator cup 18 and for enabling a radial compression of the body portion 24 of the inner body 12 during an insertion of the body portion 24 of the inner body 12 into the body portion 50 of the spiral member 14.

The first and second longitudinal tracks 26 can have distal lateral track segments 30 at the distal ends thereof and proximal lateral track segments 28 at the proximal ends thereof. The distal lateral track segments 30 can be employed to lock the elevator cup 18 in the extended disposition of FIG. 3, and the proximal lateral track segments 28 can lock the elevator cup 18 in the retracted disposition of FIG. 2. With this, inadvertent movement, namely unintended extension or retraction, of the elevator cup 18 and the retained pomade 100 can be prevented.

Figure 6:
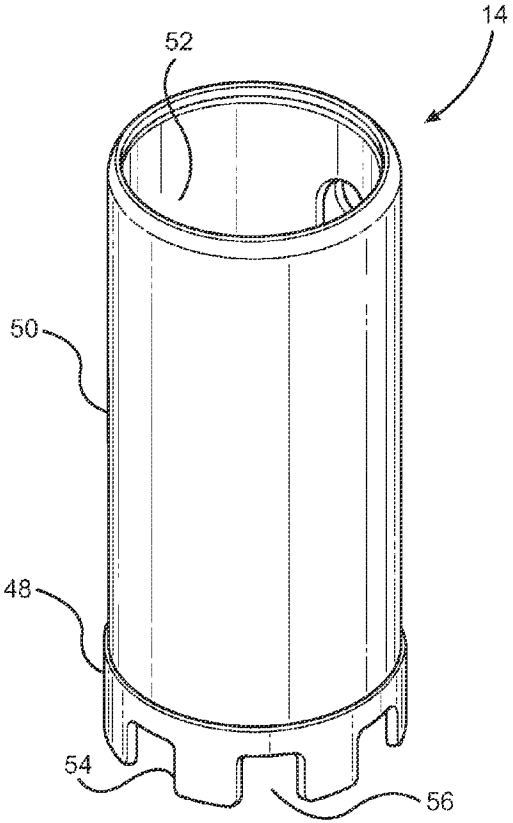
FIG. 6 is a perspective view of a spiral cam for the cosmetic dispenser of FIG. 1.
Figure 8:
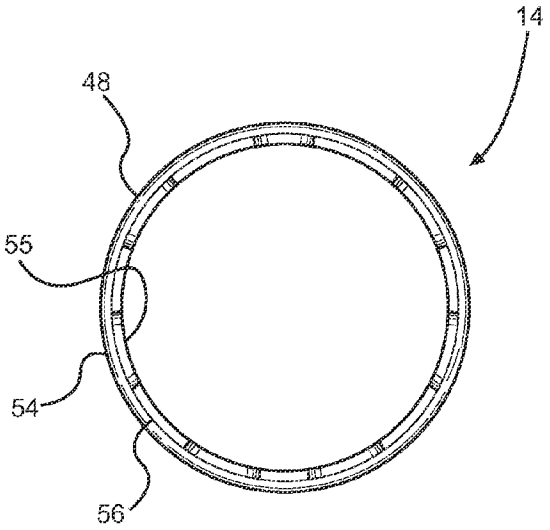
FIG. 8 is a bottom plan view of the spiral cam of FIG. 6.
Figure 7:
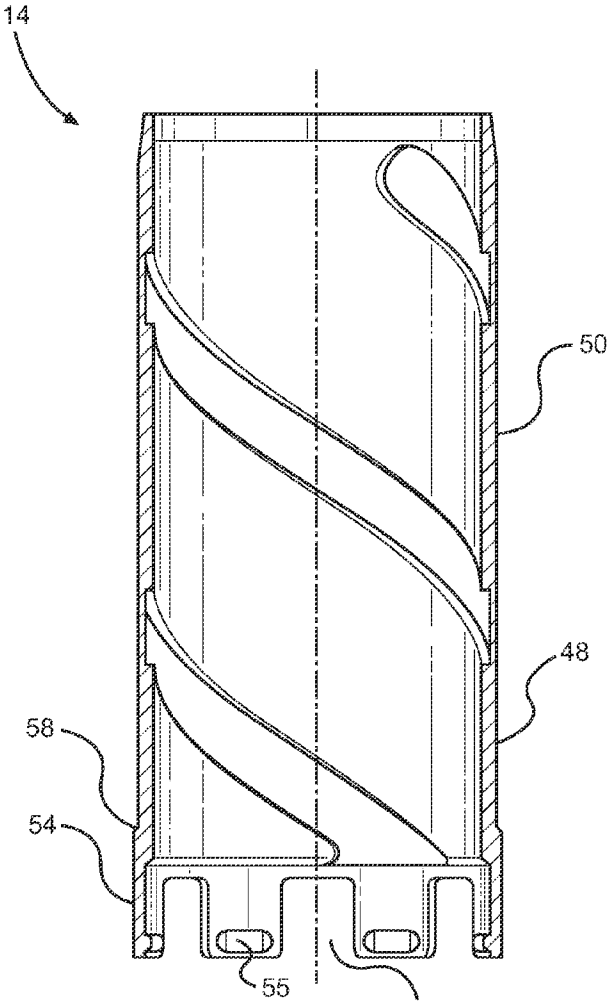
FIG. 7 is a longitudinal cross section of the spiral cam of FIG. 6.

With combined reference to FIGS. 6 through 8, one can perceive that the cylindrical spiral member 14 has a proximally disposed skirt 48 and a distally disposed body portion 50. The skirt 48 has an outer diameter greater than the outer diameter of the body portion 50 so that the tubular shell 16 can be received to encase the body portion 50 as seen, for example, in FIGS. 1 through 3. The tubular shell 16 can have an outer diameter approximately equal to the outer diameter of the skirt 48 and an inner diameter marginally larger than the outer diameter of the body portion 50 whereby a substantially consistent cylindrical outer surface is established along the outer surface of the tubular shell 16 and the outer surface of the skirt 48.

As will be described more fully hereinbelow, the spiral member 14 has an inwardly projecting shoulder 58 formed at the proximal end thereof. The shoulder 58 has an inner diameter marginally greater than the outer diameter of the annular bearing wall 32 of the inner body 12 but less than the outer diameter of the body portion 24 of the inner member 12. With that, the base portion 22 and the annular bearing wall 32 of the inner body 12 can be received through the proximal end of the spiral member 14 until the proximal end of the body portion 24 of the inner member 12 contacts the shoulder 58 of the spiral member 14 as illustrated, for example, in FIGS. 2 and 3.

The proximal end of the skirt 48 of the spiral member 14 is crenelated. As a result, the proximal end of the peripheral wall of the skirt 48 is divided into a plurality of what can be referred to as merlons 54, each arcuate in lateral cross section by virtue of being formed from a segment of the annular skirt 48. The merlons 54 are separated by interposed crenels 56. Here, there are seven merlons 54 evenly spaced evenly at approximately 51.4-degree intervals, but fewer or more merlons 54 would be possible within the scope of the invention. The merlons 54 and the interposed crenels 56 are generally equal in width, each generally rectangular in lateral profile with the corners of the crenels 56 being slightly radiused. As can be perceived by combined reference to FIGS. 6 through 8, the merlons 54 in this embodiment are integrally formed with the remainder of the spiral member 14, but that need not necessarily be the case. The merlons 54 are configured to establish an effective diameter and an effective circumference with the inner surfaces of the tips 55 of the merlons 54 tangent thereto smaller than the respective diameter and circumference of the annular bearing wall 32 of the inner body 12.

In this example, the effective diameter and circumference are established by the inner surfaces of the tips 55 is achieved, at least in part, by inwardly projecting protuberances at the tips 55 of the merlons 54. When the cosmetic dispenser 10 is fully assembled as in FIGS. 1 through 3, the tips 55 of the merlons 54 thus press against the annular bearing wall 32 to provide smooth and consistent frictional resistance to the rotation of the inner body 12 relative to the spiral member 14. It would additionally or alternatively be possible to employ an inward angling of the merlons 54, as by a frusto-conical formation of the proximal end of the skirt 48.

Advantageously, the consistency of the frictional resistance provided by the merlons 54 as they ride against the annular bearing wall 32 of the inner body 12 is achieved not only by the advantageous material selection disclosed herein but also by the merlons 54 themselves and the arcuate cross sections of the merlons 54. By virtue of their arcuate cross sections, the merlons 54 provide further resistance to unintended outward deflection and buckling. With that, controlled, consistent frictional resistance can be achieved.

Moreover, the merlons 54 have lengths sufficient to cause the ends of the merlons 54 to be in immediate juxtaposition, potentially in direct, sliding contact, with the smooth bearing surface 34 of the inner body 12 when the cosmetic dispenser 10 is fully assembled. Where the merlons 54 are in sliding contact with the bearing surface 34, further frictional resistance can be created between the spiral member 14, through the merlons 54, and the inner body 12, through the smooth bearing surface 34.

The smooth bearing surface 34, the annular bearing wall 32, and the merlons 54 cooperate to minimize or eliminate any relative play between the components of the cosmetic dispenser 10.

The body portion 50 of the spiral member 14 has a smooth outer wall surface and an inner wall surface with spiral formations, which in this example comprise helical or spiral channels 52, communicating therealong. It will be noted that, although spiral channels 52 are depicted in the instant embodiment, the spiral formations alternatively could comprise spiral threads, spiral ridges, or any other spiral or helical arrangement. In any case, first and second spiral channels 52 or other spiral formations can be disposed in general opposition to one another thereby to enable a receipt and engagement of the opposed elevator lugs 62 of the elevator cup 18.

The inner diameter of the distal body portion 50 of the spiral member 14 and the outer diameter of the peripheral wall 60 of the elevator cup 18 can be calibrated to allow the elevator cup 18 to slide axially in relation to the spiral member 14, such as by having the outer diameter of the peripheral wall 60 be slightly less than the inner diameter of the distal body portion 24. Similarly, the elevator lugs 62 and the opposed spiral channels 52 can be dimensioned to enable a sliding of the elevator lugs 62 along the spiral channels 52, such as by having the distance between the outer tips of the elevator lugs 62 slightly less than the diameter established by the spiral channels 52.

Under this arrangement, the inner body 12 can be rotatably engaged with the spiral member 14 as shown, for example, in FIGS. 1 through 3. The body portion 24 of the inner body 12 can be received within the body portion 50 of the spiral member 14 with the merlons 54 of the spiral member 14 overlying and pressing laterally inwardly against the annular bearing surface 32 to provide lateral frictional resistance to the rotation of the inner body 12 relative to the spiral member 14. Simultaneously, the distal ends of the merlons 54 can frictionally engage or be disposed in immediate proximity to the bearing surface 34 such that the merlons 54 press longitudinally against the bearing surface 34 or are restrained form longitudinal movement by the bearing surface 34. Where the merlons 54 and the bearing surface 34 are in frictional engagement, the merlons 54 and the bearing surface 34 provide longitudinal frictional resistance to rotation of the inner body 12 relative to the spiral member 14.

The inner body 12, the outer body 14 also referred to as the spiral member 14, and the elevator cup 18 in cooperation act as a rotary extension and retraction mechanism. More particularly, the inner body 12 can be manually rotated in relation to the spiral member 14, such as by a gripping of the base portion 22 of the inner body 12. The elevator cup 18, and thus a pomade 100, can be manipulated between the retracted configuration depicted in FIG. 2 and the extended configuration depicted in FIG. 3 by a rotation of the inner body 12 in relation to the spiral member 14. To do so, a user could grip the inner body 12, such as by gripping the base portion 22 with a first hand, and then engage the spiral member 14 either directly or by use of the shell 16, such as with a second hand. Next, torque sufficient to rotate the inner body 12 in relation to the spiral member 14 can be applied. As the inner body 12 is rotated in relation to the spiral member 14, the elevator cup 18 will be prevented from rotating in relation to the inner body 12 by engagement of the lugs 62 with the longitudinal tracks 26. With that, the elevator lugs 62 will slide along the helical tracks 52 to yield an axial movement of the elevator cup 18 and the retained pomade 100. Relative rotation in a first direction will induce an extension of the elevator cup 18 while relative rotation in a second, opposite direction will induce a retraction of the elevator cup 18 and the retained pomade 100.

So constructed and assembled, the lateral and longitudinal frictional resistance between the inner body 12 and the spiral member 14 together and individually tend to cause the cosmetic dispenser 10 to extend and retract smoothly and with consistent torque characteristics. Furthermore, the cosmetic dispenser 10 minimizes perceptible looseness and play between components. The cosmetic dispenser 10 thus imparts a firm and luxurious feel to the user that gives the perception of quality as to the cosmetic dispenser 10 and the pomade 100 retained thereby.

The dimensions of the components of the cosmetic dispenser 10 could vary within the scope of the invention as could the materials from which they are formed. Nonetheless, the illustrated and described possible and relative dimensions and materials in relation to one potential embodiment of the cosmetic dispenser 10 may assist in a better understanding of the invention. For convenience, reasonable tolerances will be assumed. It will be noted that the particular dimensions and dimensional relations will vary depending on the needs and goals of the manufacturer and on the materials from which the components are formed.

Advantageously, the cosmetic dispenser 10 is operative with the only location of interference being where the necessary frictional swivel torque is created. This compares favorably to many prior art designs where multiple points generated the frictional torque. Where multiple points are employed, it becomes difficult to control the torque within a desired swivel torque range. Furthermore, in view of the constant location of the frictional engagement, the swivel torque tends to be consistent throughout the entire extension and retraction processes. This again compares favorably to many prior art designs where swivel torque often varies during elevation or retraction of the elevator cup since the variation commonly derived not only from the need for multiple points of frictional contact but also since some or all of the contact points moved during operation, which tends to hamper consistency. For example, with many prior art cases, bumps on the outside wall of the elevator cup interfere with the inside wall of the inner body, but the inner body is open at the top so that the torque tends to be lower when the elevator cup is moving in the upper portion of the inner body as compared to the lower portion. Manufacturers of such designs may be forced to introduce lubrication to keep the torque within the desired range and to make operation of the device feel smooth, but the present structure seeks to be operative with smooth and consistent friction without a need for lubrication, which is advantageous for plural reasons. While designs have been developed that purport to be operative without lubrication, they commonly require additional components, which is undesirable. Additional components and assembly steps are not necessary under the disclosed structure.

In addition to the structural improvements disclosed herein, preferred embodiments of the cosmetic dispenser 10 exploit optimal material selection for improved performance. For instance, low coefficient of friction materials permit the initiation of movement without perceptible static friction. Moreover, rotational noise will be minimized and relative component displacement will be prevented to give a sound and feel of quality. Embodiments of the cosmetic dispenser 10 using engineering grade polyoxymethylene (POM) for the spiral member 14 contribute to the ability to avoid the use of lubrication while functioning as described while also avoiding fatigue so that consistent swivel torque will be maintained throughout the life of the cosmetic dispenser 10. By employing outward stress on the merlons 54 to produce frictional resistance as shown and described, the merlons 54 are designed not to fatigue over time.

While the annular bearing wall 32 in the present embodiment is depicted as being adjacent to the base portion 22 of the inner body 12, it will be noted that, except as the invention might be expressly limited by the claims, the lateral bearing surface formed by the annular bearing wall 32 could be otherwise disposed, such as at a mid-portion or at the distal end of the inner body 12. It should also be appreciated that the merlons 54, the lateral bearing surface, and the longitudinal bearing surface could be otherwise configured. For instance, rather than having the merlons 54 project from the component comprising the spiral member 14, the merlons 54 could project from another component of the cosmetic dispenser 10, such as from the inner body 12. Under such a construction, the lateral and longitudinal bearing surfaces could be disposed on or retained by, for instance, the spiral member 14. Moreover, in certain embodiments, there might not be a defined line or border between the lateral bearing surface and the longitudinal bearing surface.

Still further, other rotary extension and retraction mechanisms are possible and within the scope of the invention. By way of example and not limitation, the inner body 12, the outer body 14, and the elevator cup 18 could also cooperate to act as a rotary extension and retraction mechanism through a threaded stem for the elevator cup 18 in combination with a threaded aperture retained, for instance, relative to the inner body 12 or the outer body 14. With a threaded engagement between the stem and the inner body 12 or the outer body 14, the elevator cup 18 can be selectively extended or retracted by a relative rotation of the inner body 12 and the outer body 14.

Figure 12:
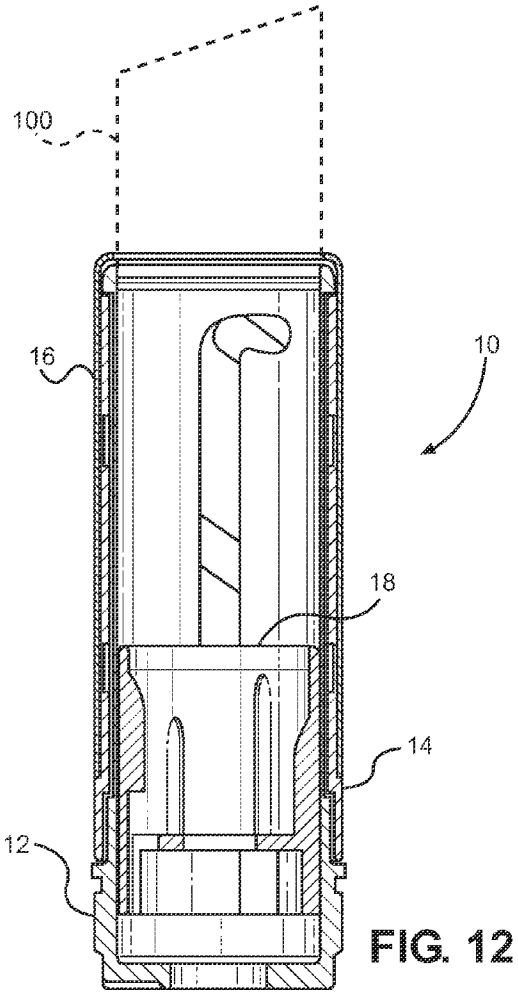
FIG. 12 is a longitudinal cross section of the cosmetic dispenser of FIG. 11 in a retracted disposition.
Figure 11:
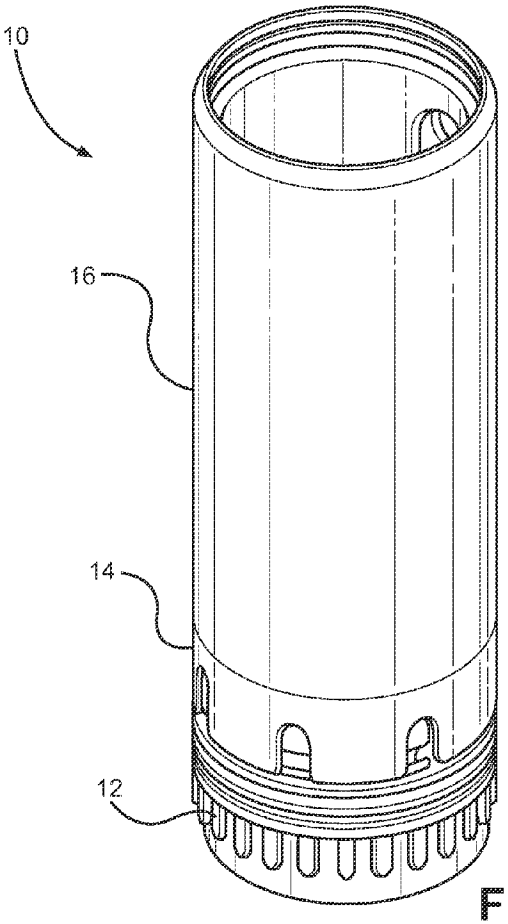
FIG. 11 is a perspective view of an alternative cosmetic dispenser with a crenelated wall for frictional resistance according to the present invention.
Figure 13:
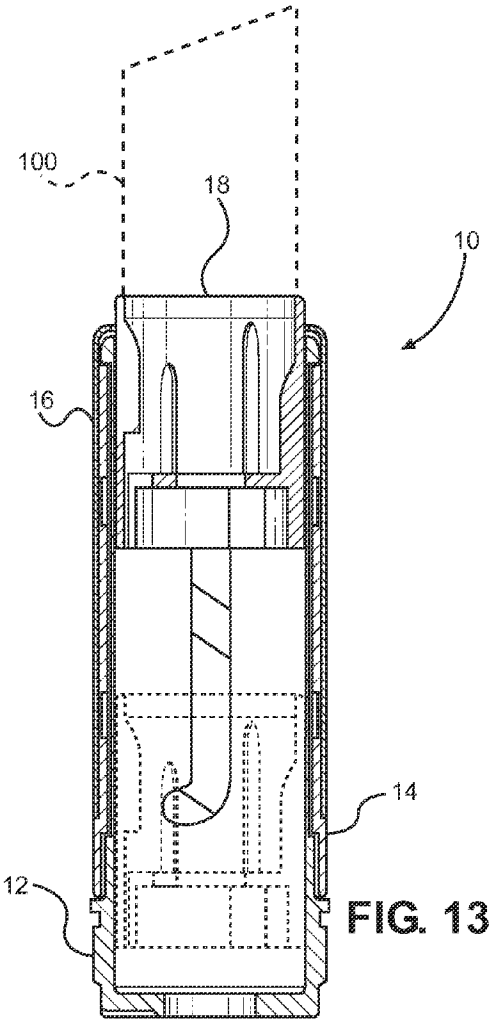
FIG. 13 is a longitudinal cross section of the cosmetic dispenser of FIG. 11 in an extended disposition.

It will be understood that even further constructions are possible under the teachings set forth herein. By way of example and not limitation, an alternative embodiment of the cosmetic dispenser 10 is illustrated in FIGS. 11 through 13. The cosmetic dispenser 10 is again founded on a tubular inner body 12 that is rotatably engaged with a spiral member 14. Relative rotation between the inner body 12 and the spiral member 14 yields an axial movement of an elevator cup 18 and a retained pomade 100 between the extended disposition depicted in FIG. 13 and the retracted disposition depicted in FIG. 12. A tubular shell 16 again partially or substantially encases the distal portion of the spiral member 14 and, derivatively, the elevator cup 18 disposed therewithin. The elevator cup 18 can be as previously described and shown.

Figure 14:
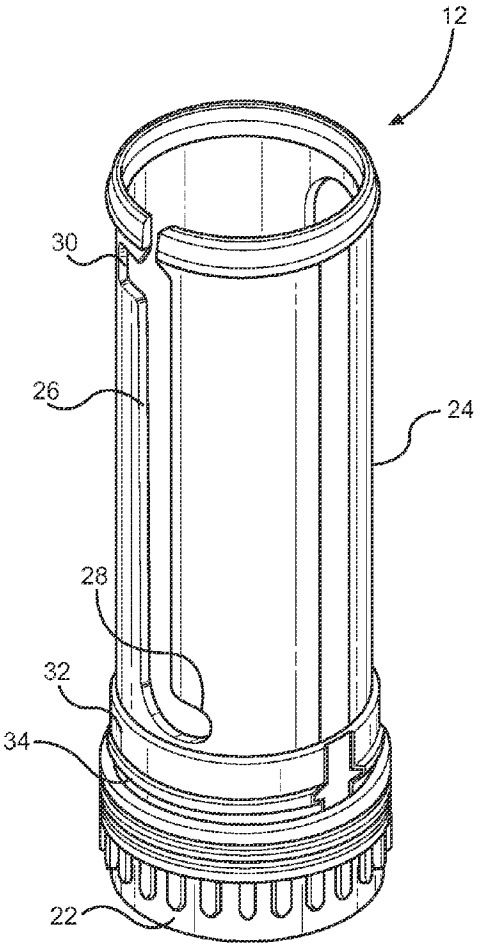
FIG. 14 is a perspective view of an inner body pursuant to the instant invention.
Figure 15B:
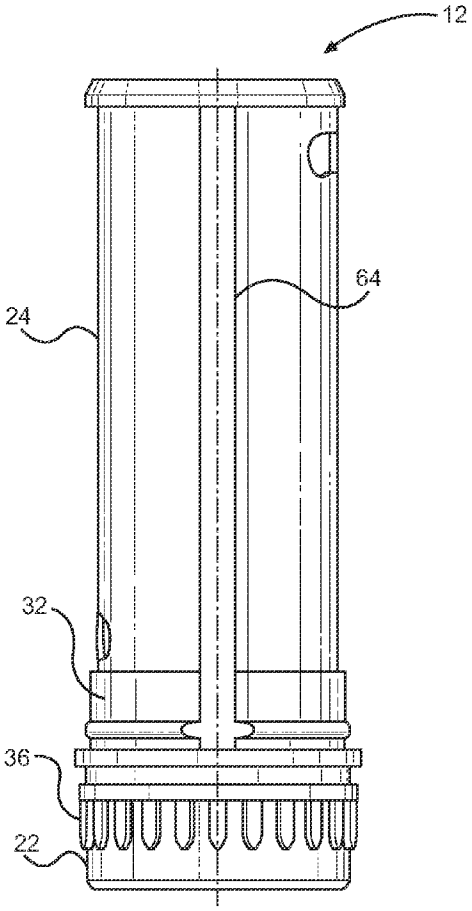
FIG. 15B is a view in side elevation of the inner body of FIG. 14.
Figure 15A:
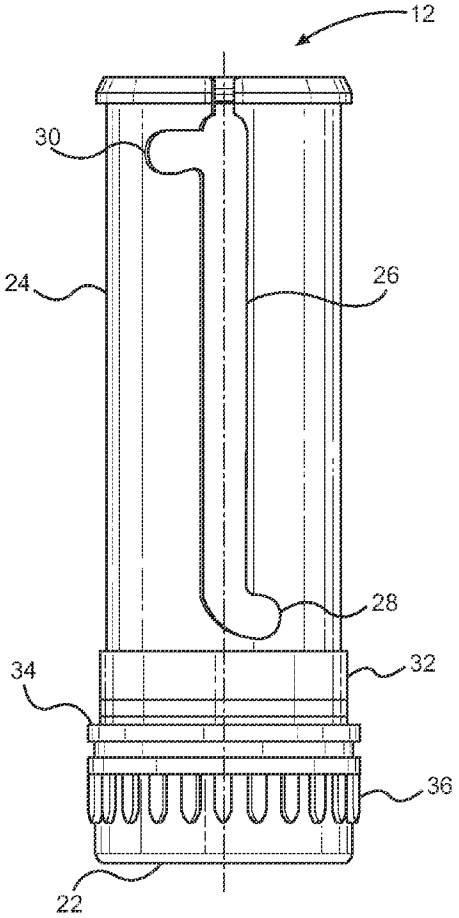
FIG. 15A is a view in front elevation of the inner body of FIG. 14.
Figure 17:
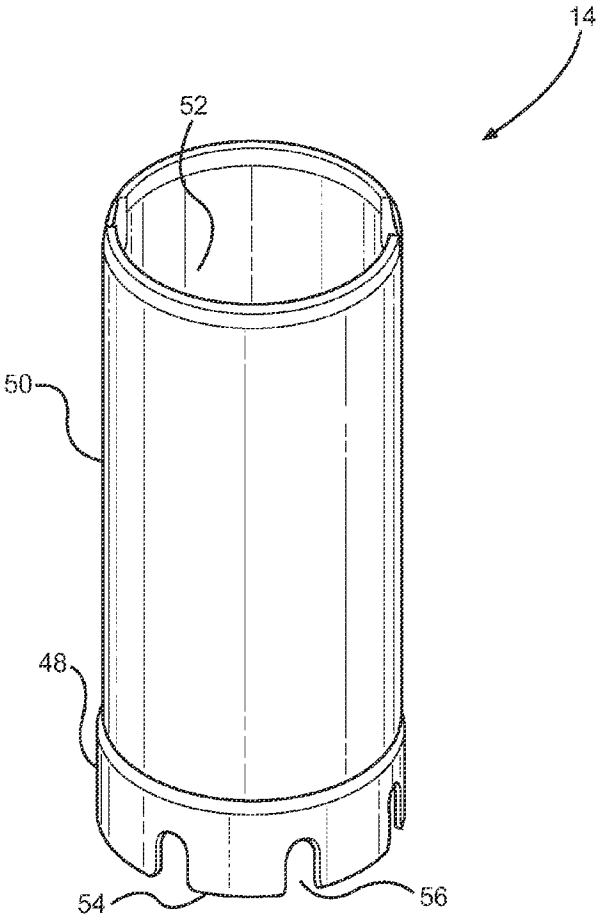
FIG. 17 is a perspective view of a spiral cam for the cosmetic dispenser of FIG. 11.
Figure 16:
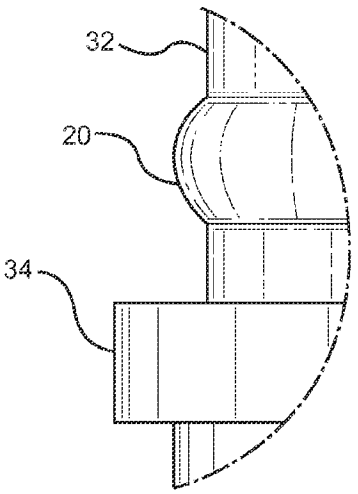
FIG. 16 is an amplified view of the portion of the inner body indicated at G in FIG. 15B.
Figure 19:
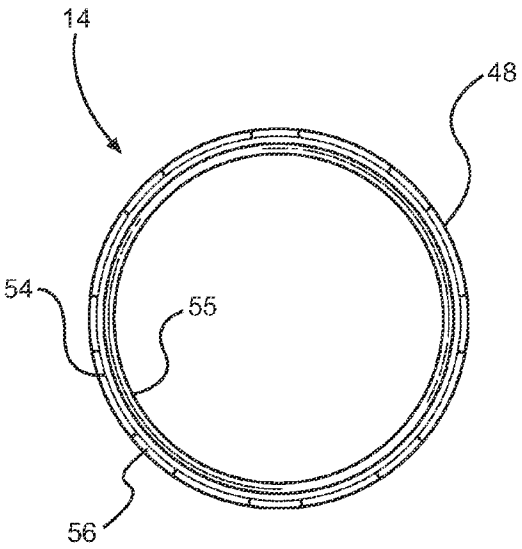
FIG. 19 is a bottom plan view of the spiral cam of FIG. 17.
Figure 18:
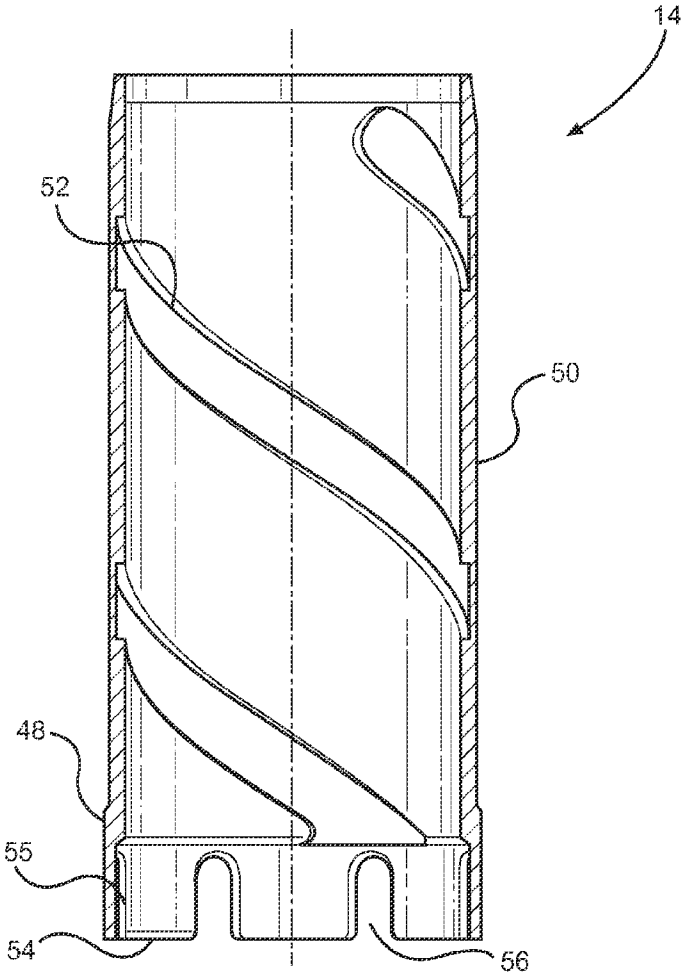
FIG. 18 is a longitudinal cross section of the spiral cam of FIG. 17.

As before, the tubular inner body 12, which is shown apart in FIGS. 14, 15A, and 15B, has a distally disposed body portion 24 for being received into a body portion 50 of the spiral member 14, which is seen alone in FIGS. 17 through 19. The inner body 12 has a base portion 22 disposed at a proximal end thereof, such as by being formed integrally therewith, and a smooth annular bearing wall 32 is interposed between the body portion 24 and the base portion 22. Again, the annular bearing wall 32 is concentric with the inner body 24 and longitudinally aligned with the body portion 24 and the inner body 12 in general. The annular bearing wall 32 thereby presents what can be referred to as a lateral bearing surface in that lateral force can bear against the annular bearing wall 32. In the present embodiment, however, an annular, peripheral ridge 20 is disposed to encircle the annular bearing wall 32 completely or substantially as is best seen by combined reference to FIGS. 15A, 15B, and 16. It will again be noted that, except as the invention might be expressly limited by the claims, the lateral bearing surface, here formed by the annular bearing wall 32, could be otherwise disposed, such as at a mid-portion or at the distal end of the inner body 12.

As in the previous embodiment, the inner body 12 has first and second opposed longitudinal tracks 26 that communicate along a substantial length of the body portion 24 of the inner body 12. The longitudinal tracks 26 are disposed in general opposition and pass entirely through the body portion 24 so that the elevator lugs 62 of the elevator cup 18 pass through the longitudinal tracks 26 to engage the opposed spiral channels 52 of the spiral member 14. The first and second longitudinal tracks 26 again have distal lateral track segments 30 at the distal ends thereof and proximal lateral track segments 28 at the proximal ends thereof for locking the elevator cup 18 in the extended and retracted positions respectively.

As before, the cylindrical spiral member 14, shown apart in FIGS. 17 through 19, has a proximally disposed skirt 48 and a distally disposed body portion 50. The skirt 48 has an outer diameter greater than the outer diameter of the body portion 50 so that the tubular shell 16 can be received to encase the body portion 50 as seen, for example, in FIGS. 11 through 13.

The spiral member 14 has an inwardly projecting shoulder 58 formed at the proximal end thereof. The shoulder 58 has an inner diameter marginally greater than the outer diameter of the annular bearing wall 32 of the inner body 12 but less than the outer diameter of the body portion 24 of the inner member 12. With that, the base portion 22 and the annular bearing wall 32 of the inner body 12 can be received through the proximal end of the spiral member 14 until the proximal end of the body portion 24 of the inner member 12 contacts the shoulder 58 of the spiral member 14 as illustrated, for example, in FIGS. 12 and 13.

As before, the proximal end of the skirt 48 of the spiral member 14 is crenelated. More particularly, the proximal end of the peripheral wall of the skirt 48 is divided into a plurality of fingers or merlons 54, each arcuate in lateral cross section by virtue of being formed from a segment of the annular skirt 48. The merlons 54 are separated by interposed crenels 56. There are again seven merlons 54 evenly spaced evenly at approximately 51.4-degree intervals. Here, however, the merlons 54 are significantly greater in angular span than the interposed crenels 56. For instance, the angular span of the merlons 54 can be approximately twice or more of the angular span of the crenels 56. The crenels 56 have semicircular end portions at the bases thereof thereby presenting narrow, arched doorways between the merlons 54. The arches of the crenels 56 further contribute to the rigidity of the merlons 54 and, thereby, the frictional engagement between the inner body 12 and the spiral member 14. Again, the merlons 54 in this example are integrally formed with the remainder of the spiral member 14, but that need not be case.

The merlons 54 and the annular bearing wall 32 of the inner body are configured to establish an effective diameter and an effective circumference with the inner surfaces of the tips 56 of the merlons 54 tangent thereto smaller respectively than the effective diameter and circumference of the annular bearing wall 32 of the inner body 12 with the annular ridge 20, where present, being considered to form a part of the annular bearing wall 32 and to contribute to the circumference thereof. In this embodiment, however, the merlons 54 do not have inwardly projecting protuberances for establishing the overlapping diameters and circumferences. Instead, the outwardly projecting annular ridge 20 establishes an effective diameter and circumference greater than the effective diameter and circumference established by the inner surfaces of the merlons 54 thereby inducing frictional resistance therebetween. When the cosmetic dispenser 10 is fully assembled as in FIGS. 11 through 13, the merlons 54 thus press against the annular ridge 20 of the annular bearing wall 32 to provide smooth and consistent frictional resistance to the rotation of the inner body 12 relative to the spiral member 14. Again, it would additionally or alternatively be possible to employ an inward angling of the merlons 54, such as by a frusto-conical formation of the proximal end of the skirt 48, or by protuberances on the merlons 54.

While the merlons 54 press inwardly against the annular ridge 20 of the annular bearing wall 32, the merlons 54 can also have longitudinal dimensions, which may or may not be the same for each merlon 54, sufficient to cause the ends of the merlons 54 to be in immediate juxtaposition or direct, sliding contact with the bearing surface 34 of the inner body 12 when the cosmetic dispenser 10 is fully assembled. Consequently, any relative play longitudinally or laterally between the components of the cosmetic dispenser 10 is minimized or eliminated thereby further contributing to the perception of quality of the cosmetic dispenser 10 and the retained pomade 100.

The body portion 50 of the spiral member 14 has a smooth outer wall surface and an inner wall surface with spiral formations, which again comprise helical or spiral threads, ridges, channels 52, or some other formation communicating therealong. The inner diameter of the distal body portion 24 of the inner body 12 and the outer diameter of the peripheral wall 60 of the elevator cup 18 can be calibrated to allow the elevator cup 18 to slide axially in relation to the inner body 12, such as by having the outer diameter of the peripheral wall 60 be slightly less than the inner diameter of the distal body portion 24. Similarly, the elevator lugs 62 and the opposed spiral channels 52 can be dimensioned to enable a sliding of the elevator lugs 62 along the spiral channels 52, such as by having the distance between the outer tips of the elevator lugs 62 slightly less than or in slight frictional engagement with the diameter established by the spiral channels 52.

Consequently, the inner body 12 can be rotatably engaged with the spiral member 14 by having the body portion 24 of the inner body 12 received within the body portion 50 of the spiral member 14 with the merlons 54 of the spiral member 14 overlying and pressing laterally against the annular ridge 20 of the bearing surface 32 to provide lateral frictional resistance to the rotation of the inner body 12 relative to the spiral member 14. Simultaneously, the distal ends of the merlons 54 frictionally engage the bearing surface 34 such that the merlons 54 press longitudinally against the bearing surface 34 to provide longitudinal frictional resistance to rotation of the inner body 12 relative to the spiral member 14.

The elevator cup 18, and thus a pomade 100 retained by the elevator cup 18, can be manipulated between the extended configuration and the retracted configuration by a rotation of the inner body 12 in relation to the spiral member 14. To do so, a user could grip the inner body 12, such as by gripping the base portion 22 with a first hand, and then engage the spiral member 14 either directly or by use of the shell 16, such as with a second hand. Next, torque sufficient to rotate the inner body 12 in relation to the spiral member 14 can be applied. As the inner body 12 is rotated in relation to the spiral member 14, the elevator cup 18 will be prevented from rotating in relation to the inner body 12 by engagement of the lugs 62 with the longitudinal tracks 26, and the elevator lugs 62 will slide along the helical tracks 52 to yield an axial movement of the elevator cup 18 and the retained pomade. Relative rotation in a first direction will induce extension while relative rotation in a second, opposite direction will induce a retraction of the elevator cup 18 and the retained pomade.

With certain details and embodiments of the present invention for a cosmetic dispenser 10 disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall define the scope of protection to be afforded to the inventor. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, any such claims shall be construed to cover not only the corresponding structure and material expressly described in this specification but also all equivalents thereof.

I claim at least the following as deserving the protection of Letters Patent:

1. A cosmetic dispenser with frictional resistance for retaining a cosmetic pomade for extension and retraction, the cosmetic dispenser comprising:

an inner body with a proximal end, a distal end, a body portion, and at least one longitudinal track that communicates along a substantial length of the body portion;

an elevator cup for retaining a pomade of cosmetic, the elevator cup comprising a peripheral wall and at least one lug that projects outwardly from the peripheral wall;

a spiral member with a proximal end, a distal end, and a body portion with at least one spiral formation along an inner surface thereof for engaging the at least one lug of the elevator cup wherein the spiral member and the inner body are rotatably engaged with a longitudinal axis of relative rotation with the body portion of the inner body received into the body portion of the spiral member whereby the elevator cup can be manipulated between an extended configuration and a retracted configuration by a selective rotation of the inner body relative to the spiral member to yield an axial movement of the elevator cup;

a first annular bearing surface retained relative to the inner body or the spiral member wherein the first annular bearing surface has a circumference;

an annular wall retained relative to the other of the spiral member or the inner body wherein the annular wall has at least a portion thereof crenelated into a plurality of merlons separated by a plurality of crenels;

wherein the plurality of merlons press against the first annular bearing surface to provide frictional resistance to a rotation of the inner body relative to the spiral member, wherein the plurality of merlons establish an effective circumference that overlaps with the circumference of the first annular bearing surface, and wherein the effective circumference of the plurality of merlons overlaps with the circumference of the first annular bearing surface at least in part by an annular ridge on the first annular bearing surface.

2. The cosmetic dispenser of claim 1 wherein the plurality of merlons surround the first annular bearing surface and wherein the effective circumference established by the plurality of merlons is smaller than the circumference of the first annular bearing surface.

3. The cosmetic dispenser of claim 1 wherein the plurality of merlons project from the spiral member and wherein the first annular bearing surface is retained by the inner body.

4. The cosmetic dispenser of claim 3 wherein the first annular bearing surface is substantially concentric with the inner body and is substantially longitudinally aligned with the longitudinal axis of rotation whereby the first annular bearing surface comprises a lateral bearing surface.

5. The cosmetic dispenser of claim 3 wherein the inner body has a base portion coupled to the body portion and wherein the first annular bearing surface comprises an annular bearing wall disposed adjacent to the base portion.

6. The cosmetic dispenser of claim 5 wherein the spiral member has a skirt coupled to the body portion wherein the skirt comprises the annular wall that has at least a portion thereof crenelated into the plurality of merlons separated by the plurality of crenels.

7. The cosmetic dispenser of claim 6 wherein the skirt is formed from polyoxymethylene (POM).

8. The cosmetic dispenser of claim 1 wherein the first annular bearing surface is substantially concentric with the inner body and the spiral member and is substantially longitudinally aligned with the body portion and the inner body.

9. The cosmetic dispenser of claim 8 further comprising a second annular bearing surface retained relative to the inner body or the spiral member relative to which the first annular bearing surface is retained wherein the second annular bearing surface is substantially concentric with the inner body and the spiral member and wherein the second annular bearing surface is generally orthogonal to the longitudinal axis of rotation whereby the second annular bearing surface comprises a longitudinal bearing surface and wherein the merlons have tips disposed in immediate juxtaposition to the second annular bearing surface.

10. The cosmetic dispenser of claim 9 wherein the tips of the merlons are in frictional contact with the second annular bearing surface.

11. The cosmetic dispenser of claim 1 wherein the plurality of merlons are each arcuate in lateral cross section.

12. The cosmetic dispenser of claim 11 wherein the crenels have bases with semicircular end portions.

13. The cosmetic dispenser of claim 1 wherein each of the plurality of merlons is significantly greater in angular span than each of the plurality of interposed crenels.

14. The cosmetic dispenser of claim 13 wherein each of the plurality of merlons has an angular span at least approximately twice an angular span of each of the plurality of crenels.

15. A cosmetic dispenser with frictional resistance for retaining a cosmetic pomade for extension and retraction, the cosmetic dispenser comprising:

an inner body with a proximal end, a distal end, a body portion, and at least one longitudinal track that communicates along a substantial length of the body portion;

an elevator cup for retaining a pomade of cosmetic, the elevator cup comprising a peripheral wall and at least one lug that projects outwardly from the peripheral wall;

a spiral member with a proximal end, a distal end, and a body portion with at least one spiral formation along an inner surface thereof for engaging the at least one lug of the elevator cup wherein the spiral member and the inner body are rotatably engaged with a longitudinal axis of relative rotation with the body portion of the inner body received into the body portion of the spiral member whereby the elevator cup can be manipulated between an extended configuration and a retracted configuration by a selective rotation of the inner body relative to the spiral member to yield an axial movement of the elevator cup;

a first annular bearing surface retained relative to the inner body or the spiral member wherein the first annular bearing surface has a circumference;

an annular wall retained relative to the other of the spiral member or the inner body wherein the annular wall has at least a portion thereof crenelated into a plurality of merlons separated by a plurality of crenels;

wherein the plurality of merlons press against the first annular bearing surface to provide frictional resistance to a rotation of the inner body relative to the spiral member and wherein the plurality of merlons project from the spiral member;

wherein the first annular bearing surface is retained relative to the inner body and wherein the first annular bearing surface is substantially concentric with the inner body and is substantially longitudinally aligned with the longitudinal axis of rotation whereby the first annular bearing surface comprises a lateral bearing surface; and a second annular bearing surface retained relative to the inner body wherein the second annular bearing surface is substantially concentric with the inner body and the spiral member, wherein the second annular bearing surface is generally orthogonal to the longitudinal axis of rotation whereby the second annular bearing surface comprises a longitudinal bearing surface, and wherein the merlons have tips disposed in immediate juxtaposition to the second annular bearing surface.

16. The cosmetic dispenser of claim 15 wherein the second annular bearing surface is formed by a ridge retained by the inner body.

17. The cosmetic dispenser of claim 15 wherein the tips of the merlons are in frictional contact with the second annular bearing surface.

18. A cosmetic dispenser with frictional resistance for retaining a cosmetic pomade for extension and retraction, the cosmetic dispenser comprising:

an inner body with a proximal end, a distal end, a body portion, a first annular bearing surface with a circumference, and at least one longitudinal track that communicates along a substantial length of the body portion;

an elevator cup for retaining a pomade of cosmetic, the elevator cup comprising a peripheral wall and at least one lug that projects outwardly from the peripheral wall;

a spiral member with a proximal end, a distal end, a body portion, and an annular skirt wherein the annular skirt has at least a portion thereof crenelated into a plurality of merlons separated by a plurality of crenels wherein the plurality of merlons establish an effective circumference and wherein the plurality or merlons are each arcuate in lateral cross section;

at least one spiral formation along an inner surface of the body portion for engaging the at least one lug of the elevator cup;

wherein the spiral member and the inner body are rotatably engaged with a longitudinal axis of relative rotation with the body portion of the inner body received into the body portion of the spiral member whereby the elevator cup can be manipulated between an extended configuration and a retracted configuration by a selective rotation of the inner body relative to the spiral member to yield an axial movement of the elevator cup;

wherein the plurality of merlons surround the first annular bearing surface, wherein the effective circumference established by the plurality of merlons is smaller than the circumference of the first annular bearing surface whereby the plurality of merlons press against the first annular bearing surface to provide frictional resistance to a rotation of the inner body relative to the spiral member, and wherein the first annular bearing surface is substantially concentric with the inner body and is substantially longitudinally aligned with the longitudinal axis of rotation whereby the first annular bearing surface comprises a lateral bearing surface; and a second annular bearing surface retained relative to the inner body wherein the second annular bearing surface is substantially concentric with the inner body and the spiral member, wherein the second annular bearing surface is generally orthogonal to the longitudinal axis of rotation whereby the second annular bearing surface comprises a longitudinal bearing surface, and wherein the merlons have tips disposed in immediate juxtaposition to the second annular bearing surface.

19. A cosmetic dispenser with frictional resistance for retaining a cosmetic pomade for extension and retraction, the cosmetic dispenser comprising:

an inner body with a proximal end, a distal end, and a body portion;

an elevator cup for retaining a pomade of cosmetic;

an outer body with a proximal end, a distal end, and a body portion wherein the outer body and the inner body are rotatably engaged with a longitudinal axis of relative rotation with the body portion of the inner body received into the body portion of the outer body;

a rotary extension and retraction mechanism wherein the elevator cup can be manipulated between an extended configuration and a retracted configuration by a selective rotation of the inner body relative to the outer body to yield an axial movement of the elevator cup;

a first annular bearing surface retained relative to the inner body or the outer body wherein the first annular bearing surface has a circumference;

an annular wall retained relative to the other of the outer body or the inner body wherein the annular wall has at least a portion thereof crenelated into a plurality of merlons separated by a plurality of crenels;

wherein the plurality of merlons press against the first annular bearing surface to provide frictional resistance to a rotation of the inner body relative to the outer body; and a second annular bearing surface retained relative to the inner body or the outer body relative to which the first annular bearing surface is retained wherein the second annular bearing surface is substantially concentric with the inner body and the outer body, wherein the second annular bearing surface is generally orthogonal to the longitudinal axis of rotation whereby the second annular bearing surface comprises a longitudinal bearing surface, and wherein the merlons have tips disposed in immediate juxtaposition to the second annular bearing surface.

20. The cosmetic dispenser of claim 19 wherein the inner body has at least one longitudinal track that communicates along a substantial length of the body portion, wherein the elevator cup has a peripheral wall and at least one lug that projects outwardly from the peripheral wall, and wherein the outer body comprises a spiral member with at least one spiral formation along an inner surface of the body portion for engaging the at least one lug of the elevator cup whereby the inner body, the outer body, and the elevator cup in cooperation act as the rotary extension and retraction mechanism.

21. The cosmetic dispenser of claim 19 wherein the plurality of merlons are each arcuate in lateral cross section.

22. The cosmetic dispenser of claim 19 wherein the plurality of merlons establish an effective circumference that overlaps with the circumference of the first annular bearing surface and wherein the effective circumference of the plurality of merlons overlaps with the circumference of the first annular bearing surface at least in part by an annular ridge on the first annular bearing surface.

* * * * *